US006883406B2

(12) United States Patent
Yang

(10) Patent No.: US 6,883,406 B2
(45) Date of Patent: Apr. 26, 2005

(54) SHANK RETAINING BASE FOR SCREWDRIVER

(75) Inventor: Ming-Li Yang, Changhua (TW)

(73) Assignee: Hung Yu Industrial Co., Ltd., Changhua (TW)

( * ) Notice: Subject to any disclaimer, the term of this patent is extended or adjusted under 35 U.S.C. 154(b) by 0 days.

(21) Appl. No.: 10/458,218

(22) Filed: Jun. 11, 2003

(65) Prior Publication Data

US 2004/0250664 A1 Dec. 16, 2004

(51) Int. Cl.[7] ..... B25B 23/00
(52) U.S. Cl. ..... 81/438; 81/177.4
(58) Field of Search ..... 81/438, 489, 490, 81/177.1, 177.85, 177.4

(56) References Cited

U.S. PATENT DOCUMENTS

| | | | | |
|---|---|---|---|---|
| 4,779,493 A * | 10/1988 | White | 81/438 |
| 5,335,409 A * | 8/1994 | Elvebak | 29/451 |
| 5,533,429 A * | 7/1996 | Kozak | 81/439 |
| 5,881,614 A * | 3/1999 | Cheng-Tsan | 81/438 |
| 6,655,240 B1 * | 12/2003 | DeVecchis et al. | 81/438 |

* cited by examiner

*Primary Examiner*—David B. Thomas
(74) *Attorney, Agent, or Firm*—Troxell Law Office, PLLC

(57) ABSTRACT

A shank retaining base for a screwdriver comprises a handle, a shank body, and a base mount wherein the handle has a receiving cavity disposed the center thereof for the base mount to be adapted therein, and the base mount has a polygonal sleeve hole and a round pivot hole disposed at both ends thereof for the shank body, a polygonal rod with tool heads of different sizes disposed at both ends thereof, to be sleeve joined therein. The base mount also includes a journal section with a roller bead embedded at the upper section and a flexible means covering the outer side thereof disposed at the middle section thereof. Via a circular guide facet and equidistant retaining ribs with oblique guide edges disposed at one side of the journal section thereof, the base mount is straightly guided and smoothly pushed with pressure to the receiving cavity therein, preventing the bottom side of the handle from getting cracked or broken up in assembly. The retaining ribs thereof are securely locked at the receiving cavity therein, refraining the base mount from spinning or coming off from the handle in case of relatively great torque applied onto the shank body. Finally, the roller bead and the flexible means adapted at the receiving cavity therein are protected from outside impact, facilitating the precise retaining of the shank body at the base mount thereof without spinning therein or coming off therefrom.

3 Claims, 5 Drawing Sheets

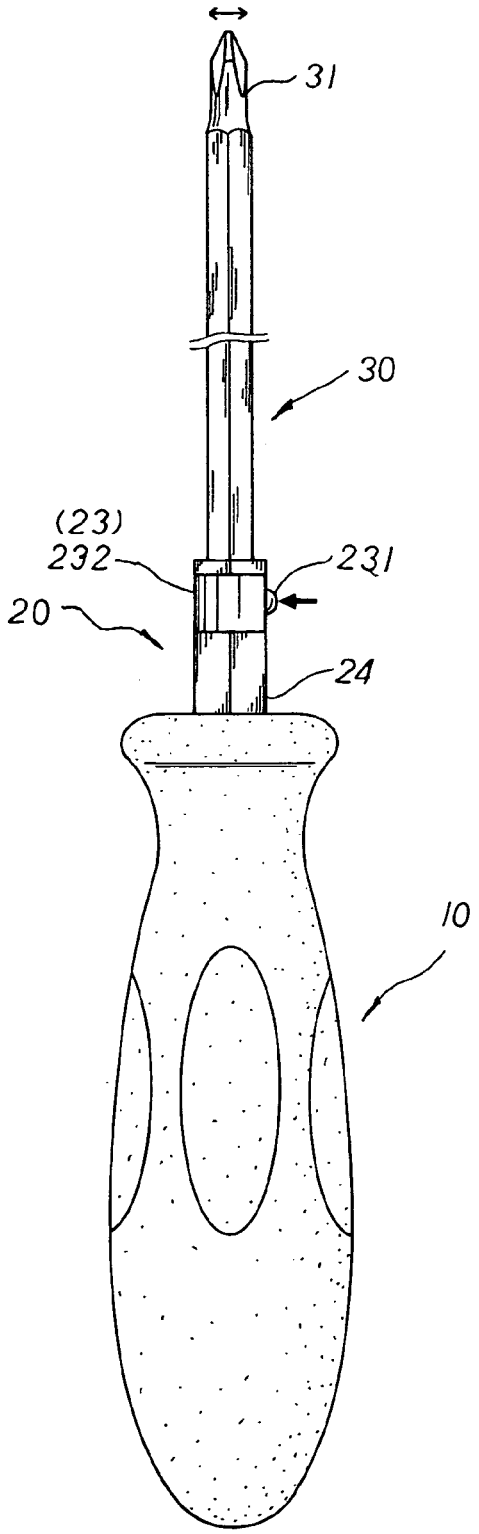
PRIOR ART FIG. 2
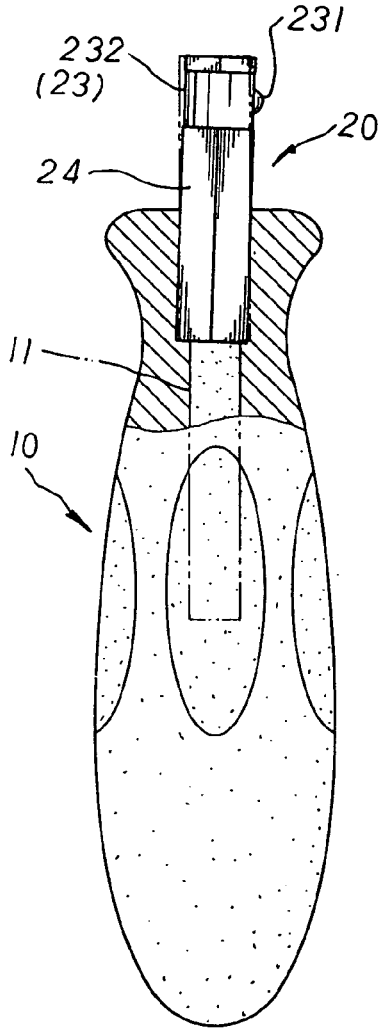
PRIOR ART
FIG. 3

SHANK RETAINING BASE FOR SCREWDRIVER

BACKGROUND OF THE INVENTION

The present invention is related to a shank retaining base for a screwdriver, comprising a handle, a shank body, and a base mount wherein the base mount has a journal section with a roller bead embedded at the upper section and a flexible means covering the outer side thereof which are adapted at a central receiving cavity of the handle therein and protected from outside impact, facilitating the precise retaining of the shank body at the base mount thereof without spinning therein or coming off there-from. Besides, via a circular guide facet and equidistant retaining ribs with oblique guide edges disposed at one side of the journal section thereof, the base mount is straightly guided and smoothly pushed with pressure to the receiving cavity therein, preventing the bottom side of the handle from getting cracked or broken up in assembly. The retaining ribs thereof are securely locked at the receiving cavity therein, refraining the base mount from spinning or coming off from the handle in case of relatively great torque applied onto the shank body.

Please refer to FIG. 1. A conventional shank retaining base for a screwdriver is mainly made up of a handle 10, a base mount 20, and a shank body 30 wherein the handle 10 has a central receiving groove 11 for the base mount 20 to be sleeve joined therein. The base mount 20 has a polygonal sleeve hole 21 disposed at one end matching to the shank body 30 thereof, a round pivot hole 22 disposed at the other end thereof, and a journal section 23 disposed at the outer periphery of one side thereof. The journal section 23 is equipped with a roller bead 231 embedded at the upper side thereof communicating with the polygonal sleeve hole 21 thereof, and a flexible means 232 covering the outer side thereof and matching to the roller bead 231 for location thereof A polygonal coupling section 24 is axially extended at one side of the journal section 23 thereof. The shank body 30 is provided with tool heads 31, 32 of different sizes at both ends thereof.

Please refer to FIG. 2. In assembly, the polygonal coupling section 24 of the base mount 20 is pushed with pressure into the central receiving groove 11 of the handle 10 thereof to join the base mount 20 at the handle 10 therein for a certain length. One end of the shank body 30 with either tool head 31, or 30 of is guided via the roller bead 231 to be sleeve joined to the polygonal sleeve hole 21 and flexibly abutted therein via the roller bead 231 thereof.

There are some drawbacks to such conventional shank retaining base for a screwdriver. First, the roller bead 231 and the flexible means 232 exposed outside the handle 10 can easily get loosened due to impact from outside as shown by the arrow in FIG. 2, failing to retain the shank body 30 securely at the base mount 20 therein. Thus, the shank body 30 can easily spin at the base mount 20 therein or even come off there-from as shown in the double arrow of FIG. 2. Second, the polygonal coupling section 24 of the base mount 20 with a flat bottom end without any guide means disposed thereon can easily get deviated and slantingly joined to the handle 10 as shown in FIG. 3. Besides, cracks A are easily produced at the outer periphery of the central receiving groove 11 thereof when the polygonal coupling section 24 of the base mount 20 is flatly pushed with pressure and joined to the handle 10 as shown in FIG. 4. Third, the polygonal coupling section 24 with smooth multi-facets at the outer periphery thereof is hard to lock the base mount 20 at the handle 10 therein. In case of relatively great torque applied onto the shank body 30, the base mount 20 can easily spin at the handle 10 therein, or even come off there-from.

SUMMARY OF THE PRESENT INVENTION

It is, therefore, the primary purpose of the present invention to provide a shank retaining base for a screwdriver, comprising a handle, a shank body, and a base mount wherein the base mount has a journal section with a roller bead embedded at the upper section and a flexible means covering the outer side thereof which, in assembly, are adapted at the handle therein and protected from outside impact, facilitating the precise retaining of the shank body at the base mount thereof without spinning therein or coming off there-from.

It is, therefore, the secondary purpose of the present invention to provide a shank retaining base for a screwdriver wherein the base mount also includes a plurality of retaining ribs each with oblique guide edges cut at both ends, and a circular guide facet disposed at one side of the journal section thereof, whereby, the base mount thereof is straightly guided to a receiving cavity of the handle and smoothly pushed with pressure to be joined therein, preventing the bottom side of the handle from getting cracked or broken up in assembly.

It is, therefore, the third purpose of the present invention to provide a shank retaining base for a screwdriver wherein the retaining ribs thereof are securely locked at the receiving cavity therein, refraining the base mount from spinning or coming off from the handle in case of relatively great torque applied onto the shank body.

BRIEF DESCRIPTION OF THE DRAWINGS

FIG. 2 is a diagram showing outside impact applied onto a roller bead of the conventional shank retaining base for a screwdriver.

FIG. 3 is sectional view of a conventional shank retaining base for a screwdriver in assembly.

DETAILED DESCRIPTION OF THE PREFERRED EMBODIMENTS

Figure 5:
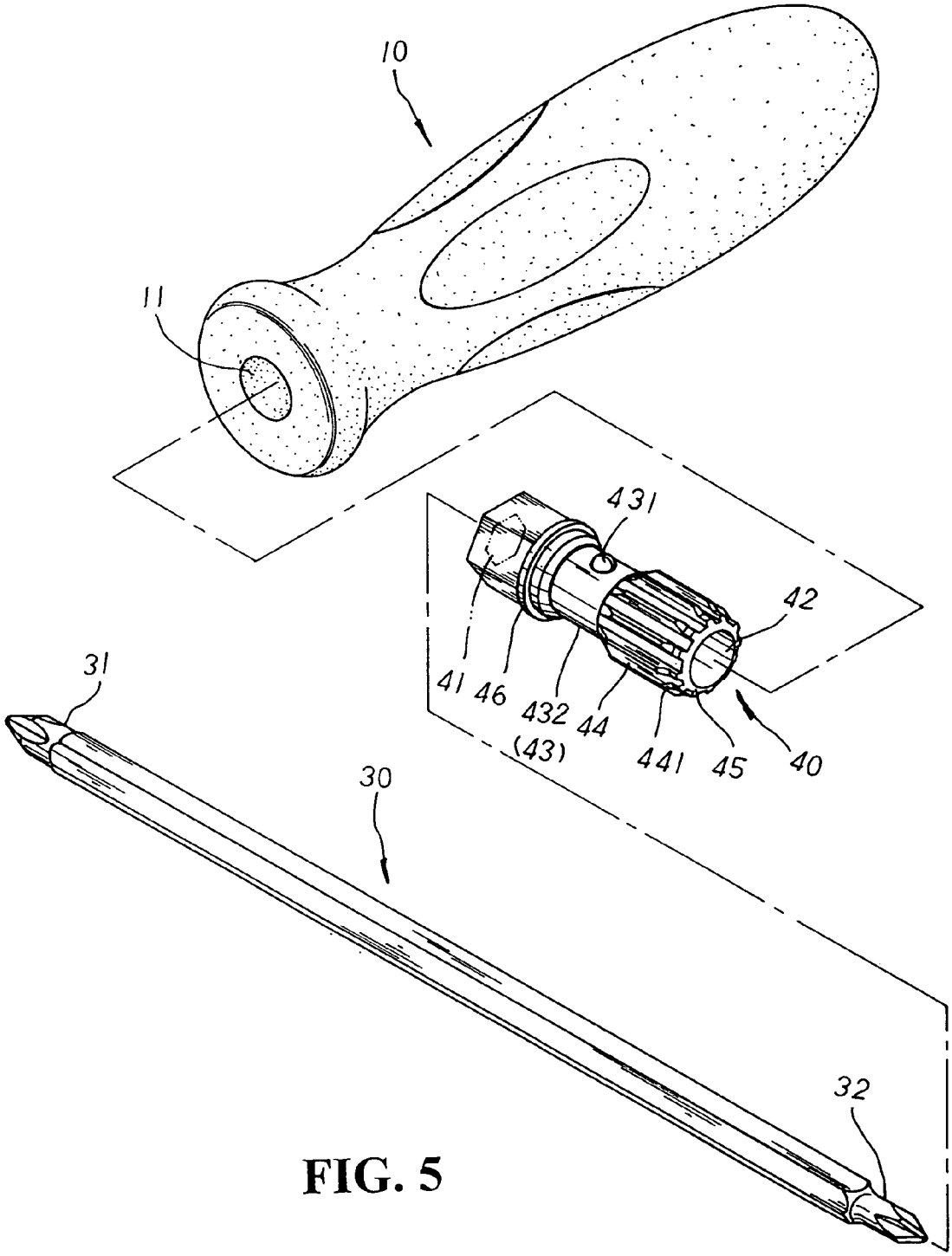
FIG. 5 is a perspective exploded view of the present invention.

Please refer to FIG. 5. The present invention is related to a shank, retaining base for a screwdriver, comprising a handle 10, a shank body 30, and a base mount 40. The handle 10 has a central receiving cavity 11 disposed at one end thereof. The shank body 30, polygonal in shape, is provided with tool heads 31, 32 of different sizes at both ends thereof. The base mount 40, made of metal, is provided with a polygonal sleeve hole 41 disposed at one end thereof matching to the polygonal shank body 30 thereof, a round pivot hole 42 disposed at the other end thereof, and a journal section 43 disposed at the outer periphery of the middle section thereof. The journal section 43 thereof has a roller bead 431 embedded at the upper side thereof communicating with the polygonal sleeve hole 41 thereof, and a flexible means 432 covering the outer side thereof and matching to the roller bead 431 for location. A plurality of equidistant retaining ribs 44 are disposed at one side of the journal section 43 thereof, each extending axially with oblique guide edges 441 cut at both ends thereof, while a stop step 46 is projecting at the other side of the journal section 43 thereof. A circular guide facet 45 is disposed at one side of the equidistant retaining ribs 44 thereof, defining the outer periphery of the round pivot hole 42 thereof.

Figure 1:
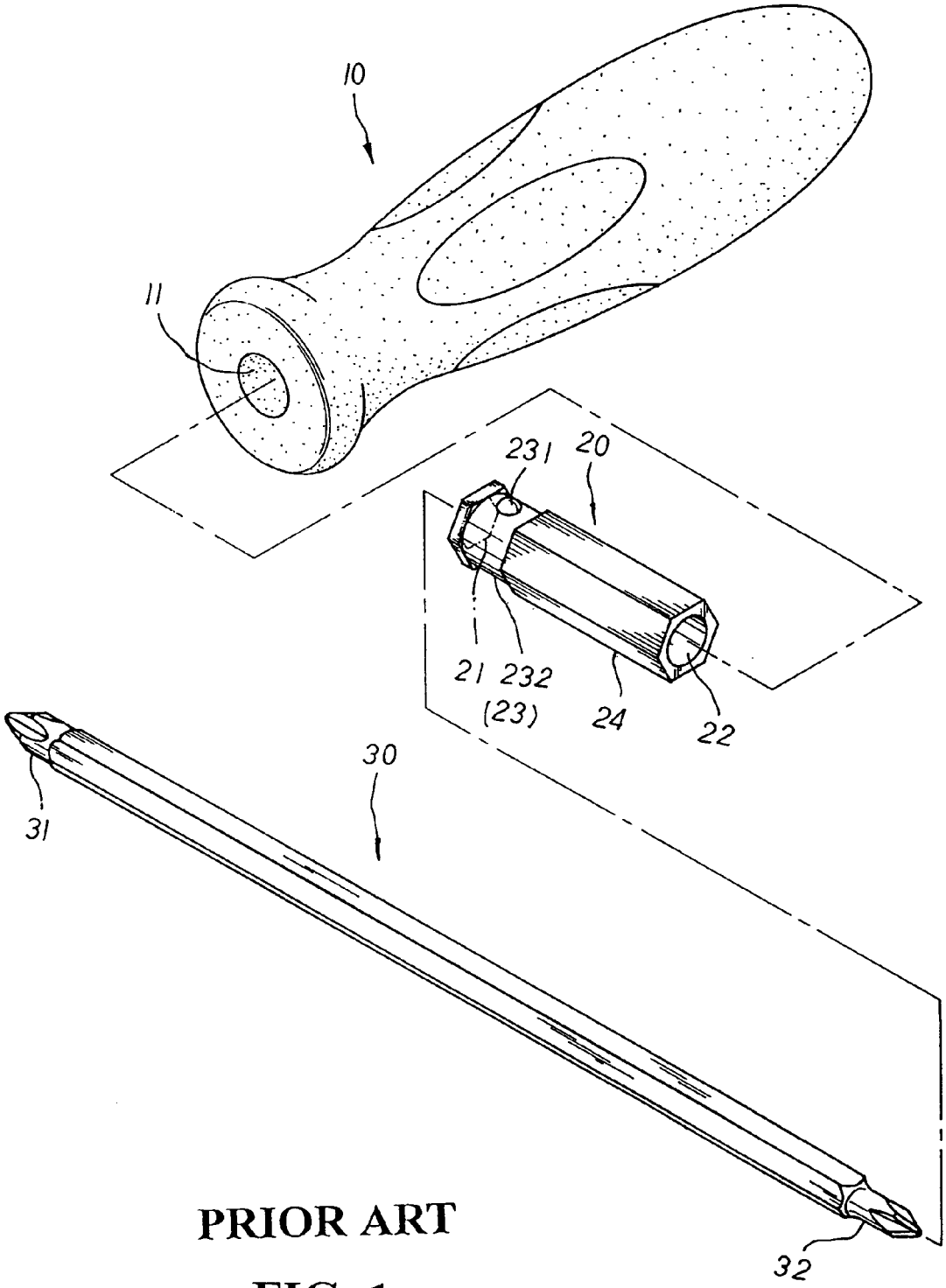
PRIOR ART FIG. 1
FIG. 1 is a perspective exploded view of a convention shank retaining base for a screwdriver.
Figure 4:
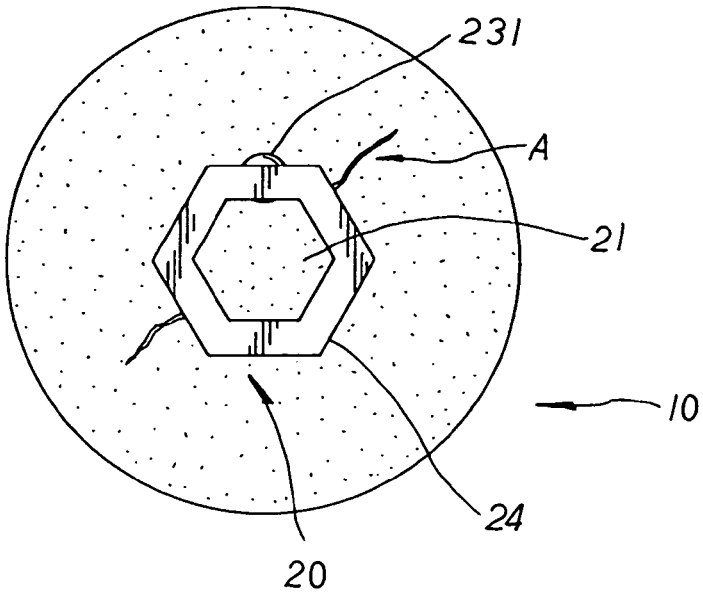
PRIOR ART FIG. 4
FIG. 4 is a cross sectional view of a conventional shank retaining base for a screwdriver.
Figure 6:
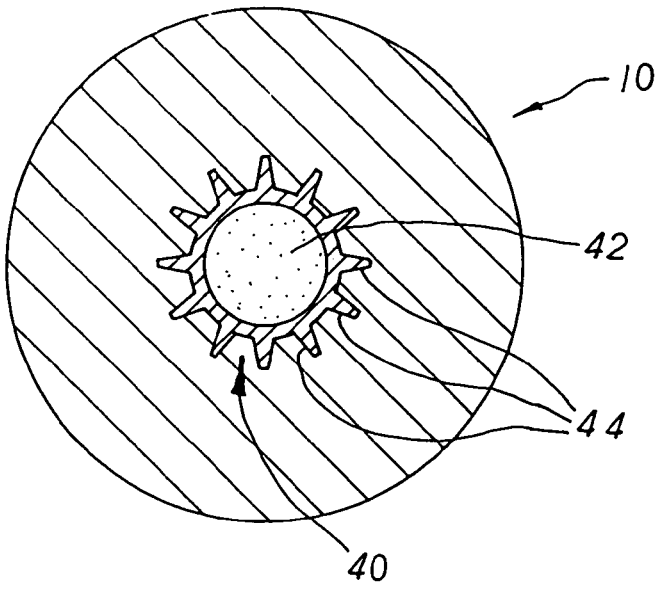
FIG. 6 is a partially cross sectional view of the present invention in assembly.
Figure 7:
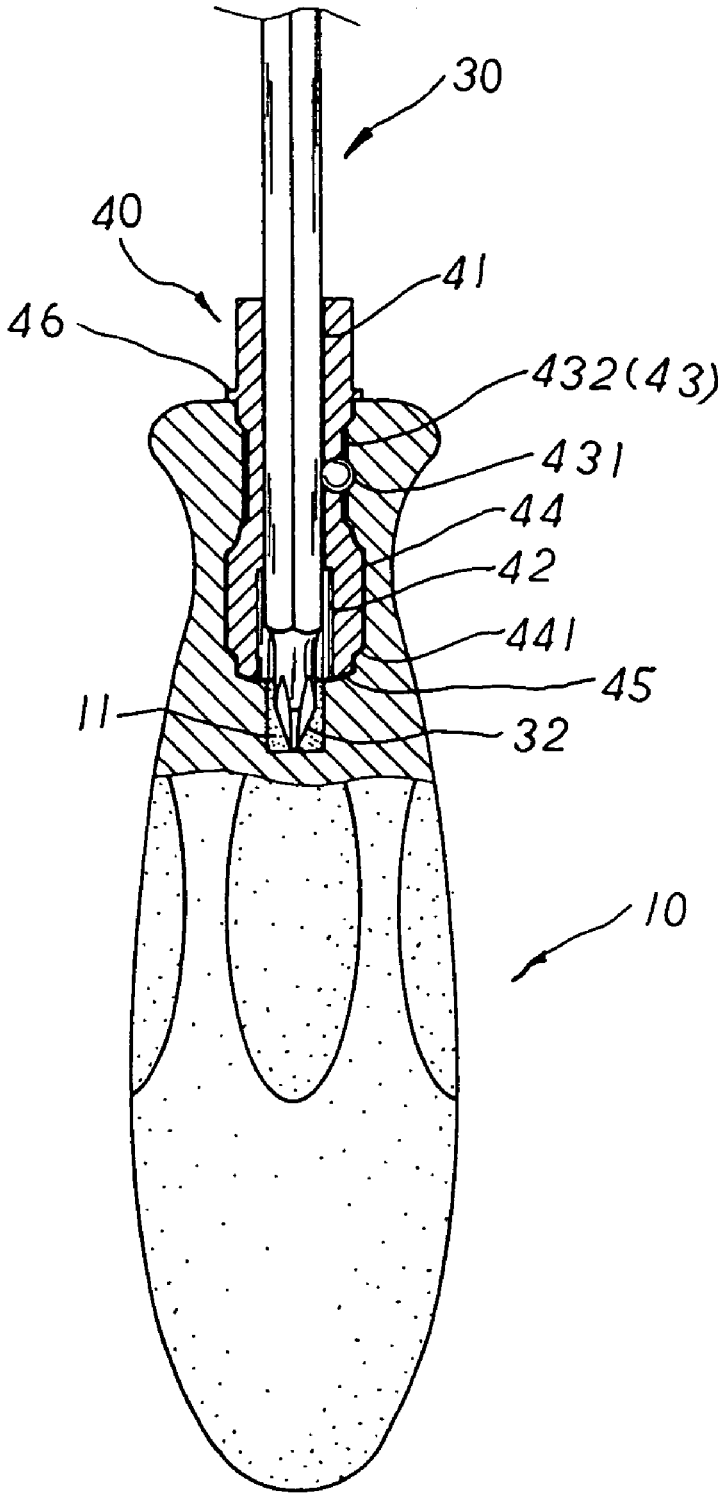
FIG. 7 is a sectional view of the present invention in assembly.

Please refer to FIGS. 6, 7. In assembly, the round pivot hole 42 of the base mount 40 is matched to the receiving cavity 11 of the handle 10 to join the base mount 40 at the handle 10 therein. Via the circular guide facet 45 and the oblique guide edges 441 thereof, the base mount 40 is straightly guided to the receiving cavity 11 of the handle 10 and smoothly pushed with pressure to be joined therein till the stop step 46 of the base mount 40 is abutted against the outer periphery of the receiving cavity 11 thereof for location, preventing the bottom side of the handle 10 from getting cracked or broken up in assembly as shown in FIG. 6. Meanwhile, the base mount 40 is securely engaged with the handle 10 via the retaining ribs 44 thereof fixedly locked at the receiving cavity 11 therein as shown in FIG. 7. Thus, in case of relatively great torque applied onto the shank body 30, the base mount 40 can be securely located at the handle 10 therein, refraining from spinning or coming off there-from. Besides, the base mount 40 is joined to the handle 10 with the roller bead 431 adapted at the receiving cavity 11 therein, protecting the roller bead 431 and the flexible means 432 thereof from outside impact. The roller bead 431 abutting against the inner side of the handle 10 also further facilitates the precise retaining of the shank body 30 at the polygonal sleeve hole 4 of the base mount 40 thereof without spinning therein or coming off there-from.

What is claimed is:

1. A shank retaining base for a screw driver comprising:

a) a handle having a central receiving cavity;

b) a base mount having:

i) a polygonal sleeve hole located through a first end portion;

ii) a round pivot hole located through a second end portion and communicating with the polygonal sleeve hole;

iii) a plurality of equally spaced retaining ribs located on the second end portion and extending axially and outwardly from an outer periphery thereof, each of the plurality of equally spaced retaining ribs having oblique guides edges at opposing ends thereof;

iv) a journal section located between the first end portion and the second end portion, the journal section having a roller bead and a flexible member positioning the roller bead;

v) a circular guide facet located on an end of the second end portion; and vi) a stop step located on an outer periphery of the first end portion adjacent to the journal section and spaced apart from an end of the second end portion, wherein the plurality of equally spaced retaining ribs and the journal section are located within the central receiving cavity of the handle, the first end portion and the stop step protrude from the central receiving cavity of the handle; and c) a polygonal shaped shank body inserted into the polygonal sleeve hole and having two tool heads, one of the two tool heads located on each of two opposing ends thereof, the roller bead engaging the polygonal shaped shank body.

2. The shank retaining base according to claim 1, wherein the polygonal sleeve hole extends through the journal section.

3. The shank retaining base according to claim 1, wherein the base mount is made of a metal.

* * * * *